United States Patent [19]

Duncan

[11] 4,207,878

[45] Jun. 17, 1980

[54] BACK PAIN RELIEVER

[76] Inventor: Zelmer L. Duncan, 2005 Catalina Ave., Santa Ana, Calif. 92701

[21] Appl. No.: 974,314

[22] Filed: Dec. 29, 1978

[51] Int. Cl.[2] ..... A61H 7/00

[52] U.S. Cl. ..... 128/67; 128/69

[58] Field of Search ..... 128/67–69, 128/60, 25 B, 24.1; 5/338

[56] References Cited

U.S. PATENT DOCUMENTS

| | | | |
|---|---|---|---|
| 712,375 | 10/1902 | Hartford | 128/69 |
| 929,449 | 7/1909 | Klimowicz et al. | 128/70 |
| 1,549,601 | 8/1925 | Mulgrew | 128/69 |
| 2,374,730 | 5/1945 | Catlin | 128/69 |
| 2,700,779 | 2/1955 | Tolkowsky | 128/68 |
| 3,292,612 | 12/1966 | Foss | 128/25 B |
| 3,795,018 | 3/1974 | Broaded | 128/70 |

FOREIGN PATENT DOCUMENTS

| | | | |
|---|---|---|---|
| 1132190 | 10/1956 | France | 128/67 |
| 122883 | 2/1919 | United Kingdom | 128/69 |

*Primary Examiner*—Lawrence W. Trapp

*Attorney, Agent, or Firm*—G. Donald Weber, Jr.

[57] ABSTRACT

A device for home or self treatment of back pain, particularly in the lower back. The device comprises a plurality of elements affixed to a suitable support member arranged in a suitable manner to provide desirable pressure relief to the user.

10 Claims, 4 Drawing Figures

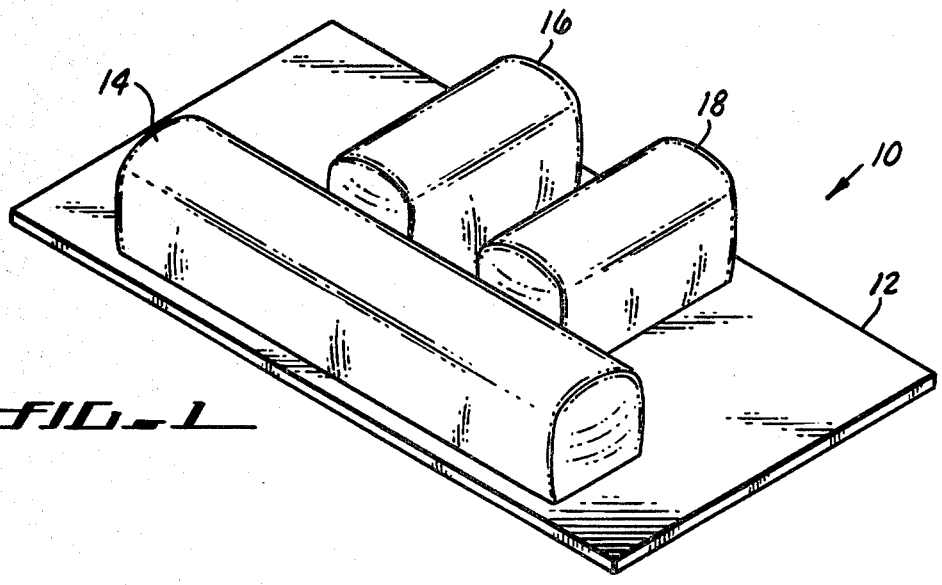
FIG. 1
FIG. 2
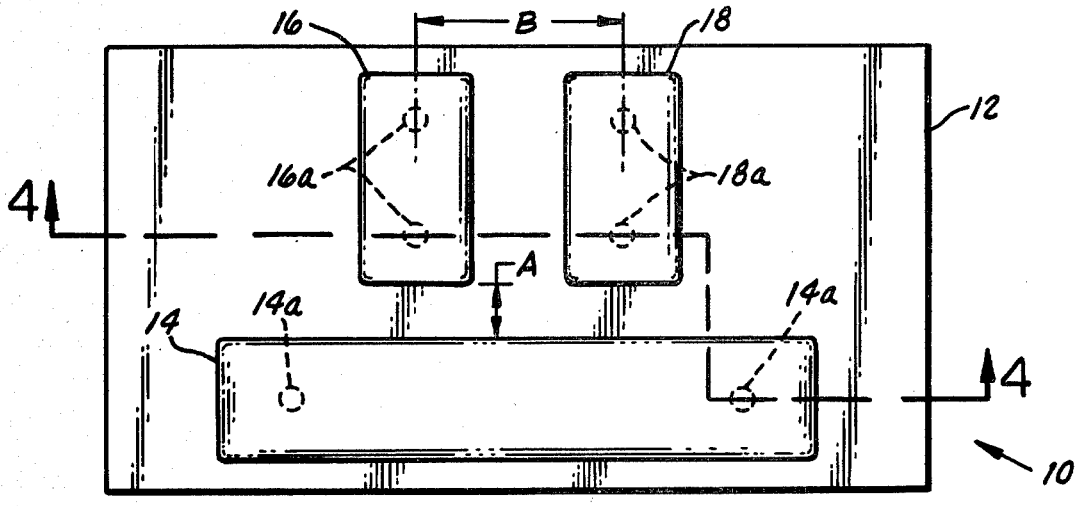
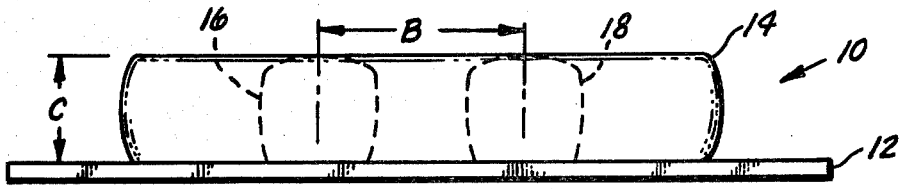
FIG. 3
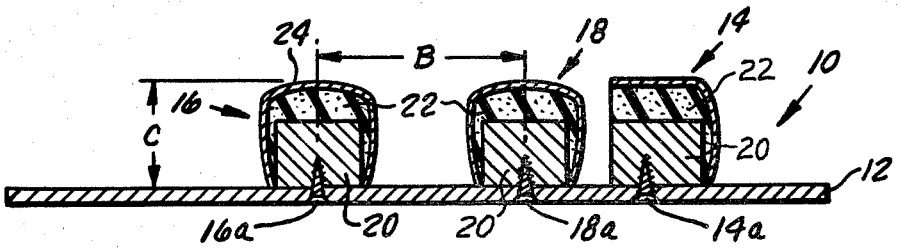
FIG. 4

BACK PAIN RELIEVER

BACKGROUND

1. Field of the Invention

This invention is directed to pain reliever devices, in general, and to passive massage-type devices for back pain, in particular.

2. Prior Art

There are millions of people who suffer from back pain, in particular, low back pain. Many people obtain no relief at all. Others seek relief in the form of medical treatment from various types of physicians, chiropractors and similar practitioners. Also, some people use very expensive, complicated equipment such as trusses, whirlpools, exercising equipment and the like. Other people use injections such as cortisone and the like.

However, most of the treatments noted are very expensive and/or otherwise unavailable to the pain sufferer. Also, specific locations, professional help or the like are required. As a result many people do not obtain the relief desired.

SUMMARY OF THE INVENTION

The invention comprises a support member which supports a plurality of pressure elements. In a preferred configuration, the elements comprise a pair of shorter elements disposed normally to a longer element. The various elements are sized and arranged to establish a preferred pattern.

DESCRIPTION OF THE DRAWINGS

FIG. 1 is perspective view of the pressure element of the instant invention.

FIG. 2 is a plan view of the instant invention.

FIG. 3 is an end view of the instant invention.

FIG. 4 is a cross-sectional view of the instant invention taken along the lines 4—4 in FIG. 2.

DESCRIPTION OF A PREFERRED EMBODIMENT

Referring now to FIG. 1, there is shown a perspective view of pressure element 10, which forms the instant invention. Element 10 comprises support structure 12 which may be a sheet of plastic, wood, metal or any other suitable material having the proper strength characteristics. In the embodiment shown, support structure 12 has dimensions of approximately 6"×12"×⅛" and is rectangular in configuration. Also, in the preferred embodiment, support structure 12 is formed of an acrylic plastic. It must be understood that other materials, shapes, configurations and the like can be used.

Elongated pressure element 14 is affixed to support structure 12 by any suitable means. Element 14 is, in the preferred embodiment, approximately 8"×1½"×1½" outside dimensions. As will appear subsequently, the outside dimensions include an upholstered (padded) covering over an inner form member.

Also affixed to support structure 12 are the relatively short pressure elements 16 and 18. Elements 16 and 18 are substantially similar to each other is size, shape and configuration. Elements 16 and 18 are also similar to element 14 in terms of construction. However, elements 16 and 18 have outside dimensions of approximately 3"×1½"×1½" and include an upholstered (padded) covering over the respective inner form members.

Referring now to FIG. 2, there is shown a plan view of the invention. Support structure 12 is shown as rectangular in configuration. Elongated element 14 is shown disposed along the long axis of structure 12. In the preferred embodiment, the edge of element 14 is located about ½" from the long edge of support structure 12 and centered relative to the ends of the support structure.

The ends of elements 16 and 18 are disposed about ½" (dimension A) from the side of element 14. Elements 16 and 18 are arranged with the axes thereof aligned essentially normal to the axis of element 14. The center-to-center distance (dimension B) between elements 16 and 18 is about 1½". These elements are also disposed about ¾" from the shorter axis of support 12 (which is also the center of element 14).

Elements 16 and 18 are mounted to support structure 12 by suitable fastening means such as screws 16A and 18A (shown dashed). In this embodiment, screws are shown. However, rivets can be used. Alternatively, nuts and bolts or other fasteners can be utilized.

Referring now to FIG. 3, there is shown an elevation view of the invention. Elongated element 14 is shown positioned on support structure 12. The relationship of elements 16 and 18 is suggested by the dashed outlines of those elements. The dimensions B and C are also shown, where B is the center-to-center distance between elements 16 and 18, while C is the height of elements 14, 16 or 18.

Referring now to FIG. 4, there is shown a cross-sectional view of the invention taken along the lines 4—4 of FIG. 2. Support structure 12 is shown. Element 16 is comprised of an inner core member 20, covered by a suitable padding 22 which is in turn covered by a vinyl covering 24. Likewise, elements 18 and 14 are constructed in a similar manner. In one embodiment, core elements 20 are formed of wood and mounted to support 12 by wood screws 16A, 18A and 14A, respectively. For convenience, the screws are applied through counter-sunk holes in support structure 12.

It must be understood that variations to the specific construction described above are possible. For example, covering 24 and padding 22 may be a single component. Also, core elements 20 may be formed integrally with support structure 12.

Also, the dimensions noted are illustrative only. Experiments have been conducted with different size elements. For example, elements 14 having lengths of 6" to 10" have been tried. Likewise, elements 16 and 18 of up to about 4" have been tried. Other widths and heights have also been tried. While these other sized elements have been successfully tested, the suggested element sizes have been found to function most satisfactorily. Thus, the best mode currently known to applicant is herewith described.

In order to utilize the invention to relieve lower back pain, the invention is used as described. Initially, device 10 is placed on a suitable flat, firm surface such as a floor, a bedboard or the like. Structure 12 is placed in contact with the surface with the elements upwardly. The user's body is then placed on the elements 14, 16 and 18 with the elements located at the pelvic level of the user's lower back. Preferably, element 14 is disposed toward the user's head for most satisfactory results.

When the user is in the recumbent position, the user moves his/her body back and forth, longitudinally, across the pain reliever device 10. Typically, moving the body alternately headward and footward (longitudinally) relieves tension and pressure on the nerves, muscles and joints thereby relieving pain to the user. By repeating this exercise with the invention, relief can be obtained. Of course, this exercise can be conducted in conjunction with the guidance, supervision and other treatment of an appropriate professional.

Thus, there is shown and described a device which reduces low back pain problems, and method therefor. Modifications can be made to the invention as noted supra. However, any such modifications which fall within the purview of this description are intended to be included as well. The description is, of course, illustrative only. The scope of this invention is limited only by the claims appended hereto.

Having thus described a preferred embodiment of the invention, what is claimed is:

1. A pain relieving device comprising,
support means having a surface,
an elongated massage element affixed to and extending above the surface of said support means, and
a pair of relatively shorter massage elements affixed to and extending above the surface of said support means in close proximity to said elongated massage element,
said shorter elements disposed parallel to each other and normal to said elongated massage element.

2. The device recited in claim 1 wherein,
said shorter elements are both disposed on the same side of said elongated massage elements.

3. The device recited in claim 1 wherein
each of said elements comprises a core member covered by padding means.

4. The device recited in claim 1 wherein
said elongated element is from 6 to 10 inches in length, and
said pair of elements are from 2 to 4 inches in length.

5. The device recited in claim 1 wherein
said elongated element is 8 inches in length, and
said pair of elements are 3 inches in length.

6. The device recited in claim 1 wherein
said support means is a planar member.

7. The device recited in claim 1, wherein
said device is intended to relieve back pain, and
said elongated massage element and said shorter massage elements are all adapted to be located at the pelvic level of the user's lower back.

8. The device recited in claim 1, wherein
said shorter massage elements are spaced from each other by about 1½ inches and from said elongated element by about ½ inch.

9. The device recited in claim 1, wherein
all of said elements are fixed in relation to each other.

10. The device recited in claim 1, wherein
all of said elements are separable from support means.

* * * * *